US008844918B1

(12) United States Patent
Milligan

(10) Patent No.: US 8,844,918 B1
(45) Date of Patent: Sep. 30, 2014

(54) MICRO ADJUSTABLE STOP

(76) Inventor: Loren Milligan, Mesa, AZ (US)

( * ) Notice: Subject to any disclaimer, the term of this patent is extended or adjusted under 35 U.S.C. 154(b) by 953 days.

(21) Appl. No.: 12/973,038

(22) Filed: Dec. 20, 2010

(51) Int. Cl.
*B25B 11/00* (2006.01)

(52) U.S. Cl.
USPC ..... 269/315; 269/303

(58) Field of Classification Search
USPC ..... 269/315, 303, 95, 166, 6, 3, 143, 249
See application file for complete search history.

(56) References Cited

U.S. PATENT DOCUMENTS

| | | | | |
|---|---|---|---|---|
| 702,217 | A * | 6/1902 | Jacob | 408/98 |
| 3,218,058 | A * | 11/1965 | Smith | 269/166 |
| 4,341,375 | A * | 7/1982 | Romanin | 269/43 |
| 6,474,632 | B1 * | 11/2002 | Liou | 269/6 |
| 6,746,006 | B2 * | 6/2004 | Thomas | 269/6 |
| 8,066,270 | B2 * | 11/2011 | Siegel | 269/279 |
| 2009/0008850 | A1 * | 1/2009 | Liou | 269/166 |
| 2010/0156015 | A1 * | 6/2010 | Klein et al. | 269/166 |

* cited by examiner

*Primary Examiner* — Lee D Wilson
(74) *Attorney, Agent, or Firm* — Schmeiser, Olsen & Watts LLP

(57) ABSTRACT

A micro adjustable stop is provided for use with wood working tools. The micro adjustable stop includes a base having a first adjustment rod, a support rod and a base plate, wherein the support rod and first adjustment rod coupled to a wood working tool on one end of the support rod and the first adjustment rod and the base plate coupled at an opposing end of the support rod and the first adjustment rod. The micro adjustable stop includes a second adjustment rod with a stop coupled at one end of the second adjustment rod. Additionally, the micro adjustable stop has an adjustment mechanism having a first end and an opposing second end, the second end comprising a micro adjustment device, wherein the first end of the adjustment mechanism is operatively coupled to the first adjustment rod and micro adjustment device is operatively coupled to the second adjustment rod.

11 Claims, 4 Drawing Sheets

MICRO ADJUSTABLE STOP

BACKGROUND OF THE INVENTION

1. Technical Field

This invention relates generally to an adjustable stop for wood working tools and more particularly to a micro adjustable stop for use with woodworking tools.

2. State of the Art

The uses of wood working tools and particularly the use of power woodworking tools has greatly increased the ability of a person to cut, shape, trim and modify wood for specific building and manufacturing purposes. Often these wood working tools are used to perform repeatable cuts of wood at particular lengths.

Manually, this is performed by measuring the length of each cut and then marking the wood at the various lengths required for cutting, lining up the marked portion of the wood and then performing the cut along the markings.

To make these repeatable cuts easier, jigs, gates or stops have been created and employed to set a particular distance from the cutting device of the wood working tool. Then the wood to be cut or otherwise processed by the wood working tool can simply be placed against the stop and cut, without the need for measuring the piece of wood to be cut.

These conventional stops are provided with very rough means of calculating the distance from the cutting device of the wood working tool. Typically, the user measures the distance from the cutting location to the end of the stop and then secures the stop. There is a certain amount of error in setting the distance and therefore results in unreliable measurements of cuts and particularly, unreliable repeatability of cuts of wood pieces.

Accordingly, there is a need in the field of adjustable stop for an improved micro adjustable stop.

DISCLOSURE OF THE INVENTION

The present invention relates to a micro adjustable stop for use with wood working tools, the micro adjustable stop including a base, a first adjustment rod, a second adjustment rod, and adjustment mechanism and a stop. The micro adjustable stop operates to allow rough adjustment of position of the stop followed by a refined micro adjustment to reach the desired stop distance from the cutting device of the wood working tool.

An embodiment includes a micro adjustable stop comprising a first adjustment rod; a second adjustment rod with a stop coupled at one end of the second adjustment rod; and an adjustment mechanism having a first end and an opposing second end, the second end comprising a micro adjustment device, wherein the first end of the adjustment mechanism is operatively coupled to the first adjustment rod and micro adjustment device is operatively coupled to the second adjustment rod.

Another embodiment includes a micro adjustable comprising a base having a first adjustment rod, wherein the base comprises a support rod and a base plate, the support rod and first adjustment rod coupled to a wood working tool on one end of the support rod and the first adjustment rod and the base plate coupled at an opposing end of the support rod and the first adjustment rod. The micro adjustable stop further comprises a second adjustment rod with a stop coupled at one end of the second adjustment rod. Further, the micro adjustable stop comprises an adjustment mechanism having a first end and an opposing second end, the second end comprising a micro adjustment device, wherein the first end of the adjustment mechanism is operatively coupled to the first adjustment rod and micro adjustment device is operatively coupled to the second adjustment rod.

Yet, another embodiment includes a method of using a micro adjustable stop comprising adjusting a stop coupled to a second adjustment rod in response to sliding an adjustment device along a first adjustment rod until the stop is approximately a desired distance from a cutting position with respect to a wood working tool; adjusting the stop to an exact desired distance from the cutting position with respect to the wood working tool in response to operating a micro adjustment device of the adjustment mechanism; placing a piece of wood to be cut on the wood working tool with an edge of the piece of wood contacting the stop; and cutting the piece of wood to a length equal to the distance of the stop from the cutting position with respect to the wood working tool.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a micro adjustable stop for use with wood working tools, the micro adjustable stop including a base, a first adjustment rod, a second adjustment rod, and adjustment mechanism and a stop. The micro adjustable stop operates to allow rough adjustment of position of the stop followed by a refined micro adjustment to reach the desired stop distance from the cutting device of the wood working tool.

Figure 1:
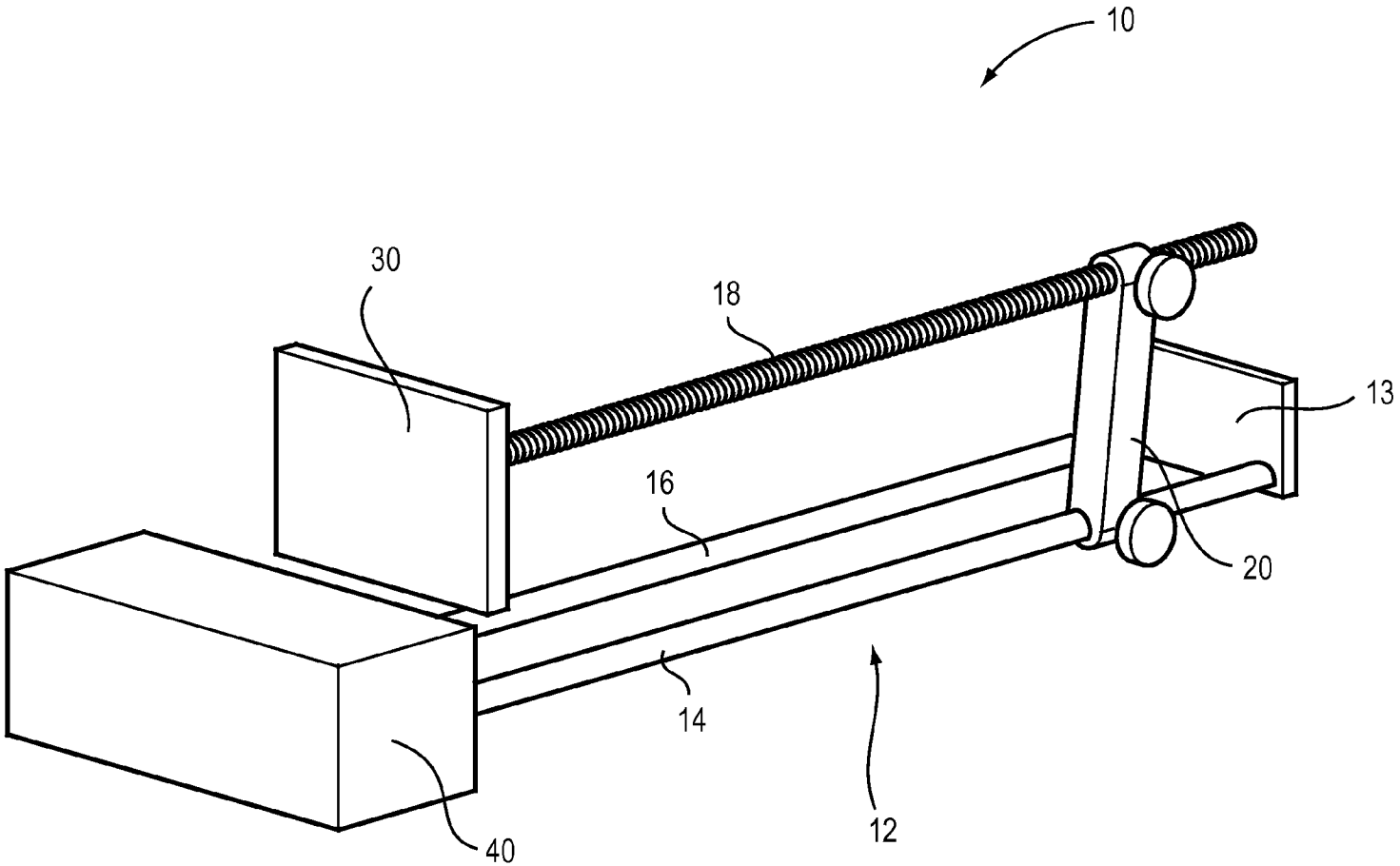
FIG. 1 is a perspective view of a micro adjustable stop.
Figure 2:
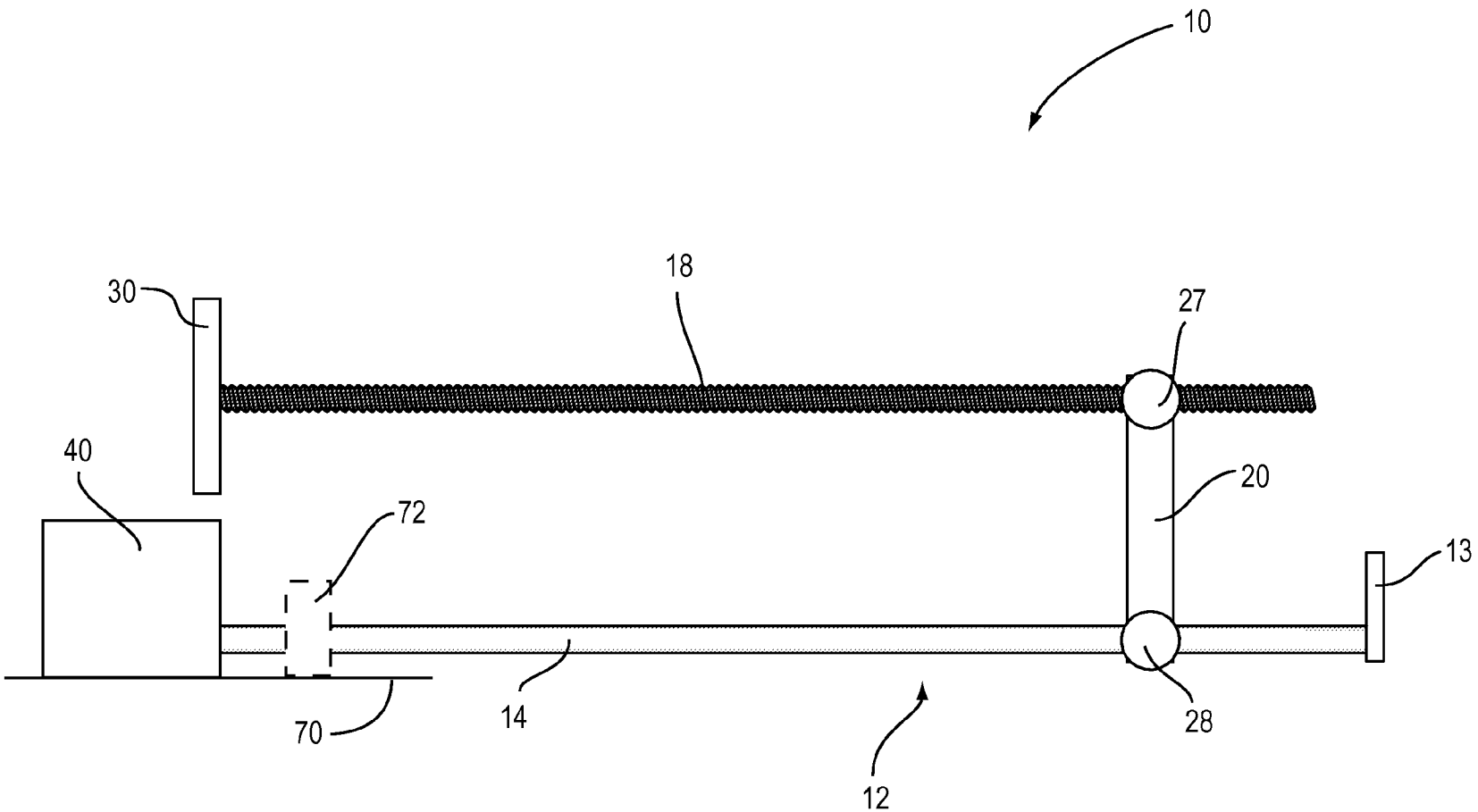
FIG. 2 is a side view of a micro adjustable stop.
Figure 3:
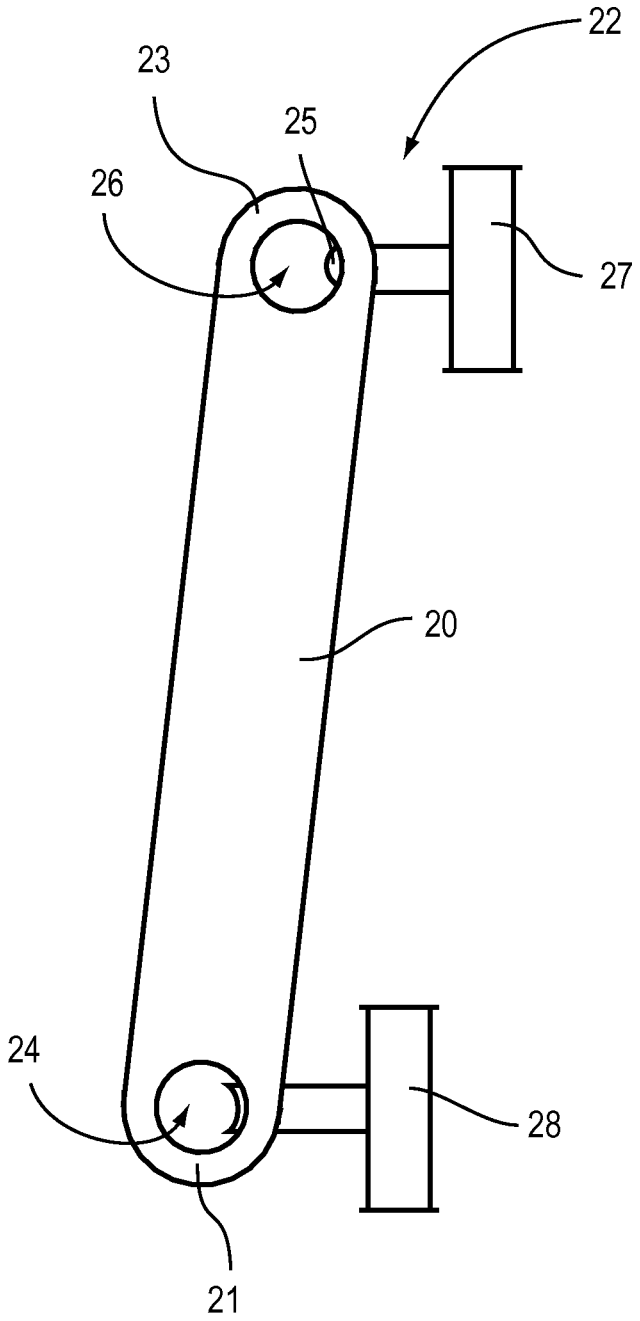
FIG. 3 is a side view of an adjustment mechanism of a micro adjustable stop.

Referring to FIGS. 1-3, a micro adjustable stop 10 is shown. The micro adjustable stop 10 comprises a base 12 having a first adjustment rod 14 and a support rod 16, a second adjustment rod 18, and adjustment mechanism 20 and a stop 30 coupled to one end of the second adjustment rod 18. The base further includes a base plate 13.

The base 12 is coupled to a wood working tool 40 or adjacent a wood working tool 40 onto a surface 70. In particular embodiments, the base 12 is coupled to the wood working tool 40 or adjacent the wood working tool 40 by coupling one end of each the support rod 16 and the first adjustment rod 14 to the wood working tool 40 or adjacent the wood working tool 40 onto a surface 70 by use of bracket 72. The base plate 13 is coupled to opposing ends of each the first adjustment rod 14 and the support rod 16.

The adjustment mechanism 20 includes a micro adjustment device 22, a first aperture 24 located at a first end 21 of the adjustment mechanism 20, a second aperture 26 located at an opposing second end 23 of the adjustment mechanism 20, and a locking device 28 located at the first end 21. The adjustment mechanism 20 may be operatively coupled to the first adjustment rod 14 at the first end 21 by receiving the first adjustment rod 14 through the first aperture 24. In this embodiment, the first end 21 of the adjustment mechanism 20 is slidingly engaged with the first adjustment rod 14. The locking device 28 may be used for securing the adjustment mechanism 20 at a selected position along the length of the first adjustment rod 14.

The micro adjustment device 22 further comprises an actuator 25 functionally engaging the second adjustment rod 18. In this embodiment, the second adjustment rod 18 is adjustable continuously along the length of the second adjustment rod 18 in response to activation of the actuator 25. This continuous adjustment along the length of the second adjustment rod 18 includes adjustment to any point along the length and does not refer to discrete position along the length of the second adjustment rod 18.

In particular embodiments the actuator 25 is a worm gear with a control knob 27, wherein rotating of the control knob 27 engages the worm gear and adjusts the second adjustment rod 18. The control knob 27 may be rotated in two directions represented by arrows 50, wherein each direction of rotation corresponds to a direction of travel represented by arrows 52. The second adjustment rod 18 is held in a fixed position when the actuator 25 is deactivated, thereby retaining the stop 30 in a fixed position at a selected distance from a cutting tool position of a wood working tool 40.

Additionally, in some embodiments, the base plate 13 determines the maximum distance the adjustment mechanism 20 is adjustable from a position of cutting with respect to the wood working tool 40 in response to preventing the adjustment mechanism 20 from sliding past the base plate 13. In other words, the base plate 13 serves as stopping device on one end of the first adjustment rod 12 and prevents the adjustment mechanism 20 from sliding off of the first adjustment rod 12.

Figure 4:
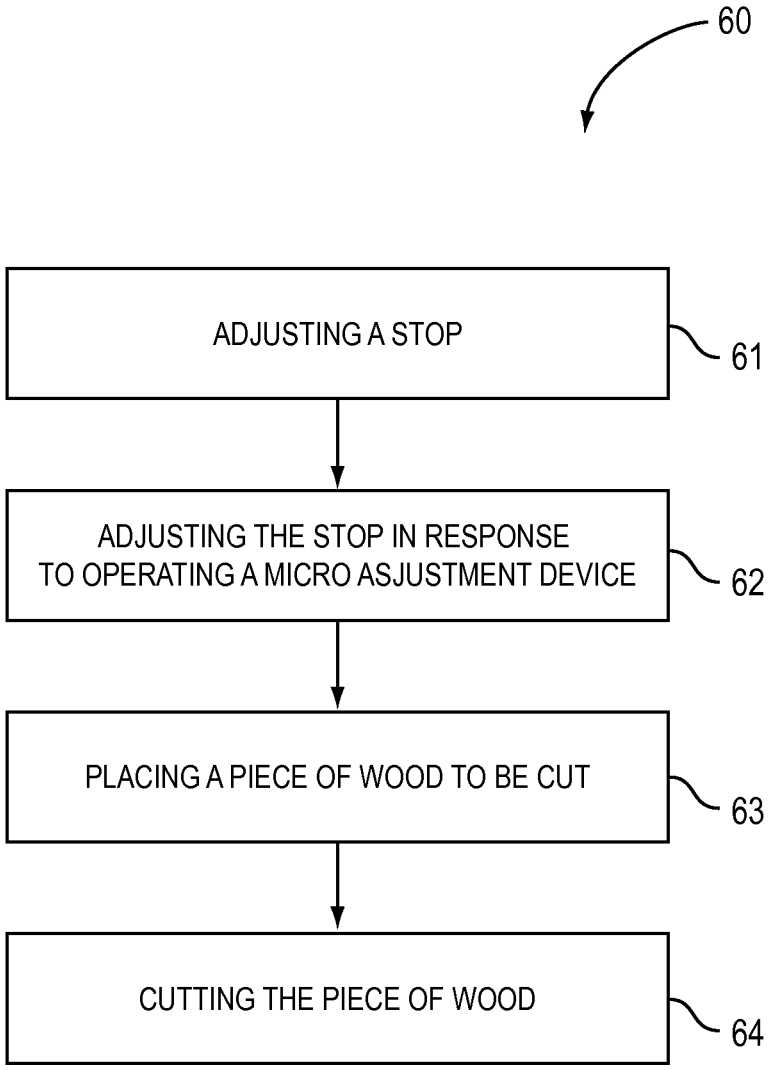
FIG. 4 is flow chart of a method of using a micro adjustable stop.

Referring to the drawings further, FIG. 4 depicts a method 60 of using a micro adjustable stop 10. The method 60 includes adjusting a stop coupled to a second adjustment rod in response to sliding an adjustment device along a first adjustment rod until the stop is approximately a desired distance from a cutting position with respect to a wood working tool (Step 61); adjusting the stop to an exact desired distance from the cutting position with respect to the wood working tool in response to operating a micro adjustment device of the adjustment mechanism (Step 62); placing a piece of wood to be cut on the wood working tool with an edge of the piece of wood contacting the stop (Step 63); and cutting the piece of wood to a length equal to the distance of the stop from the cutting position with respect to the wood working tool (Step 64). The method 60 further comprises locking the adjustment mechanism to the first adjustment rod in response to engaging a lock of the adjustment mechanism with the first adjustment rod.

In Step 61 the step of operating the micro adjustment device may comprise activating an actuator of the micro adjustment device. Further, the method 60 further comprising maintaining the second adjustment rod in a fixed position when the actuator is deactivated, thereby retaining the stop in a fixed position.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A micro adjustable stop comprising:

a first adjustment rod;

a second adjustment rod with a stop coupled at one end of the second adjustment rod; and an adjustment mechanism having a first end and an opposing second end, the second end comprising a micro adjustment device, wherein the first end of the adjustment mechanism is operatively coupled to the first adjustment rod and the micro adjustment device is operatively coupled to the second adjustment rod; the micro adjustment device further comprises an actuator functionally engaging the second adjustment rod; and the actuator is a worm gear with a control knob, wherein turning of the control knob engages the worm gear and adjusts the second adjustment rod.

2. The micro adjustable stop of claim 1, wherein the first end of the adjustment mechanism is slidingly engaged with the adjustment rod.

3. The micro adjustable stop of claim 2, wherein the adjustment mechanism further comprises a locking device for securing the adjustment mechanism at a selected position along the length of the first adjustment rod.

4. The micro adjustable stop of claim 1, wherein second adjustment rod is adjustable continuously along the length of the second adjustment rod in response to activation of the actuator.

5. The micro adjustable stop of claim 4, wherein the second adjustment rod is held in a fixed position when the actuator is deactivated, thereby retaining the stop in a fixed position at a selected distance from a cutting tool position of a wood working tool.

6. A micro adjustable stop comprising:

a base having a first adjustment rod, wherein the base comprises a support rod and a base plate, the support rod and the first adjustment rod coupled to a wood working tool on one end of the support rod and the first adjustment rod and the base plate coupled at an opposing end of the support rod and the first adjustment rod;

a second adjustment rod with a stop coupled at one end of the second adjustment rod; and an adjustment mechanism having a first end and an opposing second end, the second end comprising a micro adjustment device, wherein the first end of the adjustment mechanism is operatively coupled to the first adjustment rod and the micro adjustment device is operatively coupled to the second adjustment rod; the micro adjustment device further comprises an actuator functionally engaging the second adjustment rod; and the actuator is a worm gear with a control knob, wherein turning of the control knob engages the worm gear and adjusts the second adjustment rod.

7. The micro adjustable stop of claim 6, wherein the first end of the adjustment mechanism is slidingly engaged with the adjustment rod.

8. The micro adjustable stop of claim 7, wherein the adjustment mechanism further comprises a locking device for securing the adjustment mechanism at a selected position along the length of the first adjustment rod.

9. The micro adjustable stop of claim 8, wherein the base plate determines the maximum distance the adjustment mechanism is adjustable from a position of cutting with respect to the wood working tool in response to preventing the adjustment mechanism from sliding past the base plate.

10. The micro adjustable stop of claim 6 wherein second adjustment rod is adjustable continuously along the length of the second adjustment rod in response to activation of the actuator.

11. The micro adjustable stop of claim 10, wherein the second adjustment rod is held in a fixed position when the actuator is deactivated, thereby retaining the stop in a fixed position at a selected distance from a cutting tool position of a wood working tool.

* * * * *